US007625074B2

(12) United States Patent
Takahashi et al.

(10) Patent No.: US 7,625,074 B2
(45) Date of Patent: Dec. 1, 2009

(54) LIQUID DROPLET-JETTING APPARATUS AND INK-JET PRINTER

(75) Inventors: Yoshikazu Takahashi, Nagoya (JP); Masatomo Kojima, Ichinomiya (JP); Hiroyuki Ishikawa, Nisshin (JP); Masaharu Ito, Nagoya (JP); Shin Hasegawa, Nagoya (JP); Koichiro Hara, Nagoya (JP); Yasuhiro Sekiguchi, Nagoya (JP); Akira Iriguchi, Ichinomiya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 420 days.

(21) Appl. No.: 11/588,793

(22) Filed: Oct. 26, 2006

(65) Prior Publication Data

US 2007/0091145 A1 Apr. 26, 2007

(30) Foreign Application Priority Data

Oct. 26, 2005 (JP) ..... 2005-311671

(51) Int. Cl.
*B41J 2/045* (2006.01)

(52) U.S. Cl. ..... 347/68

(58) Field of Classification Search ..... 347/37, 347/68, 70–72

See application file for complete search history.

(56) References Cited

U.S. PATENT DOCUMENTS

| | | | |
|---|---|---|---|
| 4,611,219 | A | 9/1986 | Sugitani et al. |
| 4,694,308 | A | 9/1987 | Chan et al. |
| 4,905,017 | A | 2/1990 | Sugitani et al. |
| 6,109,734 | A | 8/2000 | Kashino et al. |
| 2004/0233254 | A1 | 11/2004 | Kim |

FOREIGN PATENT DOCUMENTS

| | | |
|---|---|---|
| EP | 1 077 331 | 2/2001 |
| FR | 2 518 901 | 7/1983 |
| JP | 1285356 | 11/1989 |
| JP | 8-39800 | 2/1996 |
| JP | 61233545 | 10/1996 |
| JP | 2003-127354 | 5/2003 |
| JP | 2005219314 | 8/2005 |

*Primary Examiner*—An H Do
(74) *Attorney, Agent, or Firm*—Reed Smith LLP

(57) ABSTRACT

An ink-jet head includes pressure chambers arranged in a row in a row-direction, and a manifold flow passage communicated with the pressure chambers and extending in the row-direction. An ink inflow port is formed at one end of the manifold flow passage. The manifold flow passage has a main portion, a connecting portion, and an extended portion which are arranged in this order from a side close to the ink inflow port. The manifold flow passage is communicated with the pressure chambers at the main portion. The main portion has a constant cross-sectional area greater than that of the connecting portion. A cross-sectional area of the extended portion is greater than that of the connecting portion. The pressure wave, generated in the pressure chamber and propagated to the manifold flow passage, can be efficiently attenuated by the manifold flow passage constructed as described above.

18 Claims, 12 Drawing Sheets

LIQUID DROPLET-JETTING APPARATUS AND INK-JET PRINTER

CROSS REFERENCE TO RELATED APPLICATION

The present application claims priority from Japanese Patent Application No.2005-311671, filed on Oct. 26, 2005, the disclosure of which is incorporated herein by reference in its entirety.

BACKGROUND OF THE INVENTION

1. Field of the Invention

The present invention relates to a liquid droplet-jetting apparatus which jets liquid droplets from discharge ports, and an ink-jet printer which jets an ink.

2. Description of the Related Art

In an ink-jet head of a certain type (liquid droplet-jetting apparatus for jetting an ink from nozzles by applying the pressure to the ink contained in pressure chambers), pressure wave which is generated when the pressure is applied to the ink contained in a certain pressure chamber included in the pressure chambers and which is propagated or transmitted to a common liquid chamber communicated with the pressure chambers, is attenuated in the common liquid chamber, thereby preventing the pressure wave from being further propagated to another pressure chamber. Accordingly, the ink jetting characteristics are suppressed from being varied. For example, Japanese Patent Application Laid-open No. 2003-127354 shows in FIG. 3 an ink-jet type recording head (ink-jet head) in which a plurality of pressure-generating chambers (pressure chambers) communicated with nozzles, respectively, are communicated with an ink storage chamber (common liquid chamber) via ink supply passages (ink supply channels); and a recess is formed in a head case at a portion corresponding to the ink storage chamber. A vibration plate and the recess function as the damper to release the pressure fluctuation (attenuate the pressure wave) in the ink storage chamber.

However, in the case of the ink-jet head described in Japanese Patent Application Laid-open No. 2003-127354, when it is intended to realize the miniaturization of the ink-jet head or the high density arrangement of the nozzles, it is necessary that the size of the ink storage chamber is decreased as well. Therefore, it is feared that the damper effect, which is brought about by the formation of the recess, may be decreased, and there is a fear that the pressure wave cannot be sufficiently attenuated.

SUMMARY OF THE INVENTION

An object of the present invention is to provide a liquid droplet-jetting apparatus and an ink-jet printer which make it possible to efficiently attenuate the pressure wave.

According to a first aspect of the present invention, there is provided a liquid droplet-jetting apparatus which jets a droplet of a liquid, the liquid droplet-jetting apparatus including: a flow passage unit which includes a plurality of pressure chambers arranged along a plane, a plurality of nozzles communicated with the pressure chambers respectively, and a common liquid chamber communicated with the pressure chambers; and an energy-applying mechanism which applies discharge energy to the liquid in the pressure chambers;

wherein the common liquid chamber includes:

an inflow port into which the liquid to be supplied to the pressure chambers is inflowed; a main portion which extends in a first direction; a connecting portion which has an end connected to one end of the main portion, which extends in a second direction, and which has a cross-sectional area, in a direction perpendicular to the second direction, smaller than a cross-sectional area of the main portion in a direction perpendicular to the first direction; and an extended portion which has an end connected to the other end of the connecting portion on a side opposite to the main portion, which extends in a third direction, and which has a cross-sectional area, in a direction perpendicular to the third direction, greater than the cross-sectional area of the connecting portion.

According to the first aspect of the present invention, for example, when the cross-sectional area of the connecting portion in the direction perpendicular to the direction in which the pressure chambers is arranged (arrangement direction) is smaller than the cross-sectional area of the main portion in the direction perpendicular to the arrangement direction of the pressure chambers, the pressure wave, which is generated in a pressure chamber when the discharge energy is applied to the liquid in the pressure chamber and which is propagated to the main portion of the common liquid chamber, behaves as follows. That is, a part of the pressure wave is reflected at the boundary between the main portion and the connecting portion to be returned to the main portion; and another part of the pressure wave is propagated through the connecting portion to be propagated further to the extended portion. Further, the cross-sectional area, of the extended portion, in a direction perpendicular to a direction in which the extended portion is extended (extending direction) is greater than the cross-sectional area of the connecting portion in the direction perpendicular to the extending direction of the connecting portion. Therefore, the pressure wave, which is propagated to the extended portion, which is reflected in the extended portion, and which is returned to the connecting portion, behaves as follows. That is, a part of the reflected pressure wave is reflected at the boundary between the extended portion and the connecting portion, and the part of the reflected pressure wave is returned to the extended portion. Further, another part of the reflected pressure wave is propagated through the connecting portion, and the another part of the reflected pressure wave is propagated to the main portion. In this manner, the process is repeated in which a part of the pressure wave is reflected at the boundary between the main portion or the extended portion and the connecting portion, and another part of the pressure wave is propagated through the connecting portion, and a part of the reflected pressure wave is reflected at the boundary between the extended portion and the connecting portion. Accordingly, the pressure wave is attenuated in the main portion, thereby making it possible to suppress the crosstalk between the pressure chambers which are communicated with each other via the common liquid chamber.

In the liquid droplet-jetting apparatus of the present invention, the pressure chambers may be arranged in the first direction; the main portion may have a substantially constant cross-sectional area in the direction perpendicular to the first direction; and the inflow port may be provided on the main portion at an area on a side opposite to the connecting portion with the pressure chambers being intervened between the inflow port and the connecting portion. In this case, the direction, in which the main portion extends, is equivalent to the direction in which the pressure chambers are arranged. Further, the cross-sectional area of the main portion is substantially constant. Therefore, the main portion can be formed accurately with ease.

In the liquid droplet-jetting apparatus of the present invention, the common liquid chamber may be defined by a wall surface of the flow passage unit, and a portion, of the wall surface, which defines the connecting portion of the common liquid chamber, may protrude as compared with other portions, of the wall surface, which define the main portion and the extended portion, respectively. Accordingly, the portion, at which the wall surface protrudes, defines the connecting portion, and the other portions, at which the wall surface does not protrude, defines the main portion and the extended portion in the common liquid chamber. Therefore, the main portion, the connecting portion, and the extended portion can be formed with ease by partially protruding the wall surface of the common liquid chamber.

Alternatively, the flow passage unit may further include a bridge which has both ends held by a wall surface, of the flow passage unit, defining the common liquid chamber, and the connecting portion may be defined by the bridge and the wall surface. Accordingly, the portion of the common liquid chamber, at which the bridge is provided, defines the connecting portion, and another portion, at which the bridge is not provided, defines the main portion and the extended portion. Therefore, the main portion, the connecting portion, and the extended portion can be formed with ease by providing the bride which has the both ends held by the wall surface on the wall surface, of the flow passage unit, defining the common liquid chamber.

In the liquid droplet-jetting apparatus of the present invention, the cross-sectional area of the extended portion may be 12 to 13 times the cross-sectional area of the connecting portion. Accordingly, the pressure wave can be attenuated efficiently.

In the liquid droplet-jetting apparatus of the present invention, the cross-sectional area of the extended portion may be greater than the cross-sectional area of the main portion. Accordingly, the pressure wave can be attenuated efficiently at the extended portion.

In the liquid droplet-jetting apparatus of the present invention, the connecting portion may include a plurality of connecting sub-portions;

the extended portion may include a plurality of extended sub-portions; and the connecting sub-portions and the extended sub-portion may be alternately formed in the first direction. Accordingly, a part of the pressure wave is reflected at the boundaries each between the main portion and one of the extended sub-portions or between the main portion and one of the connecting sub-portions; and another part of the pressure wave is propagated through each of the connecting-sub portions. Therefore, the pressure wave can be attenuated efficiently.

In the liquid droplet-jetting apparatus of the present invention, the common liquid chamber may include a first liquid chamber and a second liquid chamber; the main portion, the connecting portion, and the extended portion may be provided on each of the first and second liquid chambers; the flow passage unit may further include a linking portion which links an end, of the extended portion belonging to the first liquid chamber, on a side opposite to the connecting portion and an end, of the extended portion belonging to the second liquid chamber, on a side opposite to the connecting portion. Accordingly, the pressure wave in the extended portion of one of the first and second liquid chambers can be attenuated at the adjoining extended portion in the other of the first and second liquid chambers as well, by propagating the pressure wave of the extended portion to the adjoining extended portion via the linking portion. Therefore, the pressure wave can be attenuated efficiently.

In the liquid droplet-jetting apparatus of the present invention, the linking portion may extend in a fourth direction, and a cross-sectional area of the linking portion in a direction perpendicular to the fourth direction may be greater than the cross-sectional area of the extended portion. Accordingly, the pressure wave is easily propagated from the extended portion to the linking portion. Further, the volume of the linking portion is increased. Therefore, the pressure wave can be attenuated more efficiently in the extended portion and the linking portion.

In the liquid droplet-jetting apparatus of the present invention, the energy-applying mechanism may include a piezoelectric layer which faces the pressure chambers, and a pair of electrodes which apply an electric field to the piezoelectric layer to change a volume of the pressure chambers, Accordingly, the discharge energy can be applied to the liquid in the pressure chamber by the simple structure constructed of the piezoelectric layer and the pair of electrodes.

In this case, the piezoelectric layer may include a plurality of individual piezoelectric layers which are stacked in a multilayered form. In this case, a piezoelectric actuator of the so-called stacked type can be used as the energy-applying mechanism.

In the liquid droplet-jetting apparatus of the present invention, a gap may be formed in the flow passage unit at an area which overlaps with the common liquid chamber and which is located on a side opposite to the pressure chambers in a direction perpendicular to the plane. In this case, thickness of the lower side wall of the common liquid chamber is thinned, and the gap is formed in the wall on the side opposite to the common liquid chamber. Therefore, the gap functions as a damper, and it is possible to attenuate the pressure wave propagated through the common liquid chamber.

According to a second aspect of the present invention, there is provided a liquid droplet-jetting apparatus which jets a droplet of a liquid, the liquid droplet-jetting apparatus including: a flow passage unit having a plurality of pressure chambers, a plurality of nozzles communicated with the pressure chambers respectively, a liquid chamber commonly communicated with the pressure chambers to supply the liquid to the pressure chambers, a buffer chamber which is communicated with the liquid chamber and which stores the liquid, and a communicating portion which makes liquid communication between the liquid chamber and the buffer chamber; and an energy-applying mechanism which applies discharge energy to the liquid in the pressure chambers; wherein a flow passage area of the communicating portion is smaller than a flow passage area of each of the liquid chamber and the buffer chamber.

According to the second aspect of the present invention, the communicating portion and the buffer chamber function as a damper of a certain type. Therefore, the pressure wave, generated in a certain pressure chamber and propagated to the liquid chamber, can be quickly attenuated. Accordingly, it is possible to avoid the pressure wave from propagating to another pressure chamber.

According to a third aspect of the present invention, there is provided an ink-jet printer which performs recording on a recording medium by jetting a liquid droplet of an ink, the ink-jet printer including: an ink-jet head having a flow passage unit which has a plurality of pressure chambers arranged along a plane, a plurality of nozzles communicated with the pressure chambers respectively, and a common liquid chamber communicated with the pressure chambers; and an energy-applying mechanism which applies discharge energy to the ink in the pressure chambers; and a transport mechanism which transports the recording medium in a predetermined direction;

wherein the common liquid chamber includes: an inflow port into which the liquid to be supplied to the pressure chambers is inflowed; a main portion which extends in a first direction; a connecting portion which has an end connected to one end of the main portion, which extends in a second direction, and which has a cross-sectional area in a direction perpendicular to the second direction, the cross-sectional area being smaller than a cross-sectional area of the main portion in a direction perpendicular to the first direction; and an extended portion which has an end connected to the other end of the connecting portion on a side opposite to the main portion, which extends in a third direction, and which has a cross-sectional area, in a direction perpendicular to the third direction, greater than the cross-sectional area of the connecting portion.

According to the third aspect of the present invention, the pressure wave, which is generated in a certain pressure chamber in accordance with the jetting of the ink, is quickly attenuated in the common liquid chamber. Therefore, it is possible to suppress the occurrence of the crosstalk which would be otherwise caused by the propagation of the pressure wave to another pressure chamber.

In the present application, the term "flow passage area" means the cross-sectional area, of the flow passage, in the direction perpendicular to the direction in which the flow passage extends, i.e., the cross-sectional area in a plane perpendicular to the direction in which the flow passage extends.

DESCRIPTION OF THE PREFERRED EMBODIMENTS

A preferred embodiment of the present invention will be explained below with reference to the drawings. This embodiment is an example in which the liquid droplet-jetting apparatus of the present invention is applied to an ink-jet head which jets an ink from nozzles to perform the recording on a recording medium.

Figure 1:
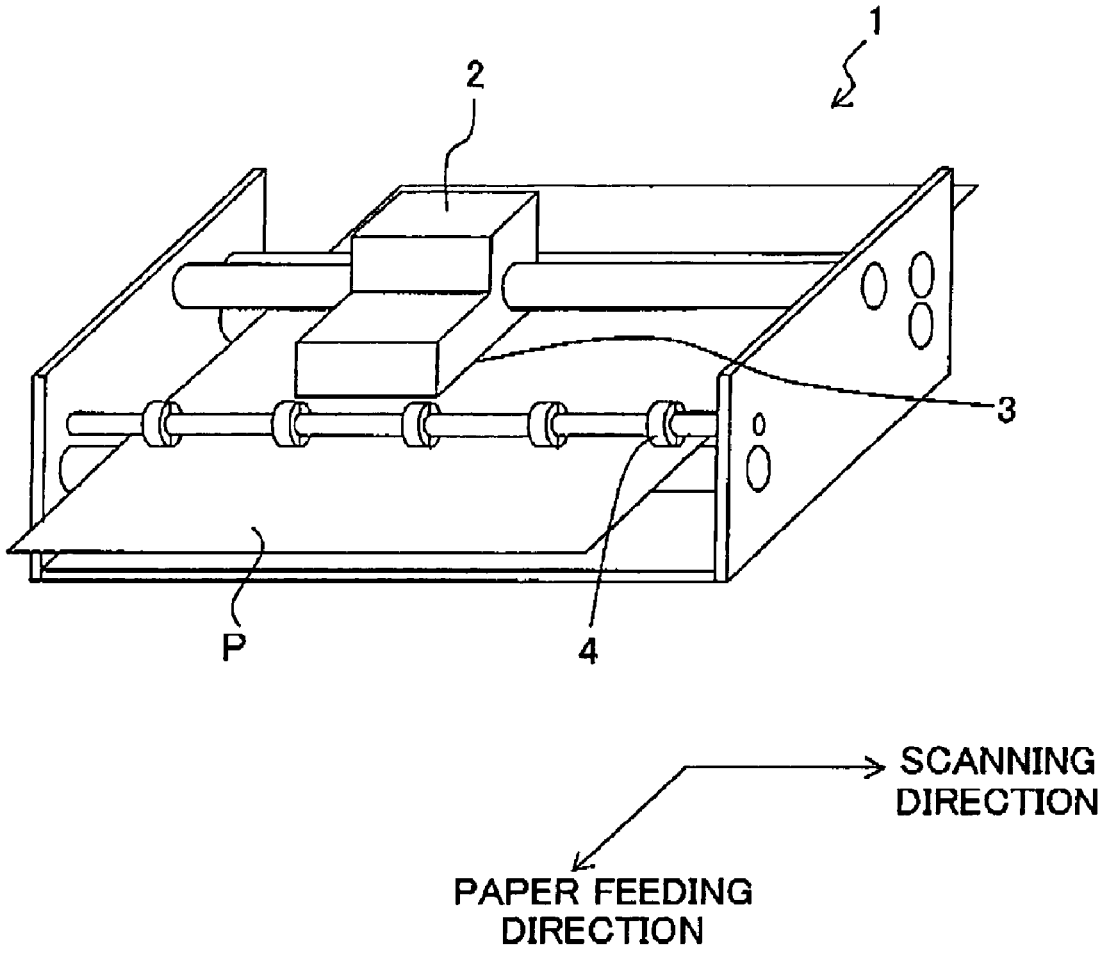
FIG. 1 shows a schematic perspective view illustrating an ink-jet printer according to an embodiment of the present invention.

FIG. 1 shows a schematic perspective view illustrating an ink-jet printer according to the embodiment of the present invention. As shown in FIG. 1, the ink-jet printer 1 includes a carriage 2 which is movable in a scanning direction (left and right direction as viewed in FIG. 1), an ink-jet head 3 based on the serial system which is attached to the carriage 2 and which jets the ink to the recording paper P, and a printing paper transport rollers 4 which transport or feed the recording paper P in a paper feeding direction (frontward direction as viewed in FIG. 1). The ink-jet head 3 performs the printing by jetting, toward the recording paper P, the ink from nozzles 17 (see FIG. 2) provided on the lower surface of the carriage 2 while moving in the scanning direction integrally with the carriage 2. The recording paper P, on which the printing has been performed by the ink-jet head 3, is discharged in the paper feeding direction by the printing paper transport rollers 4.

Figure 2:
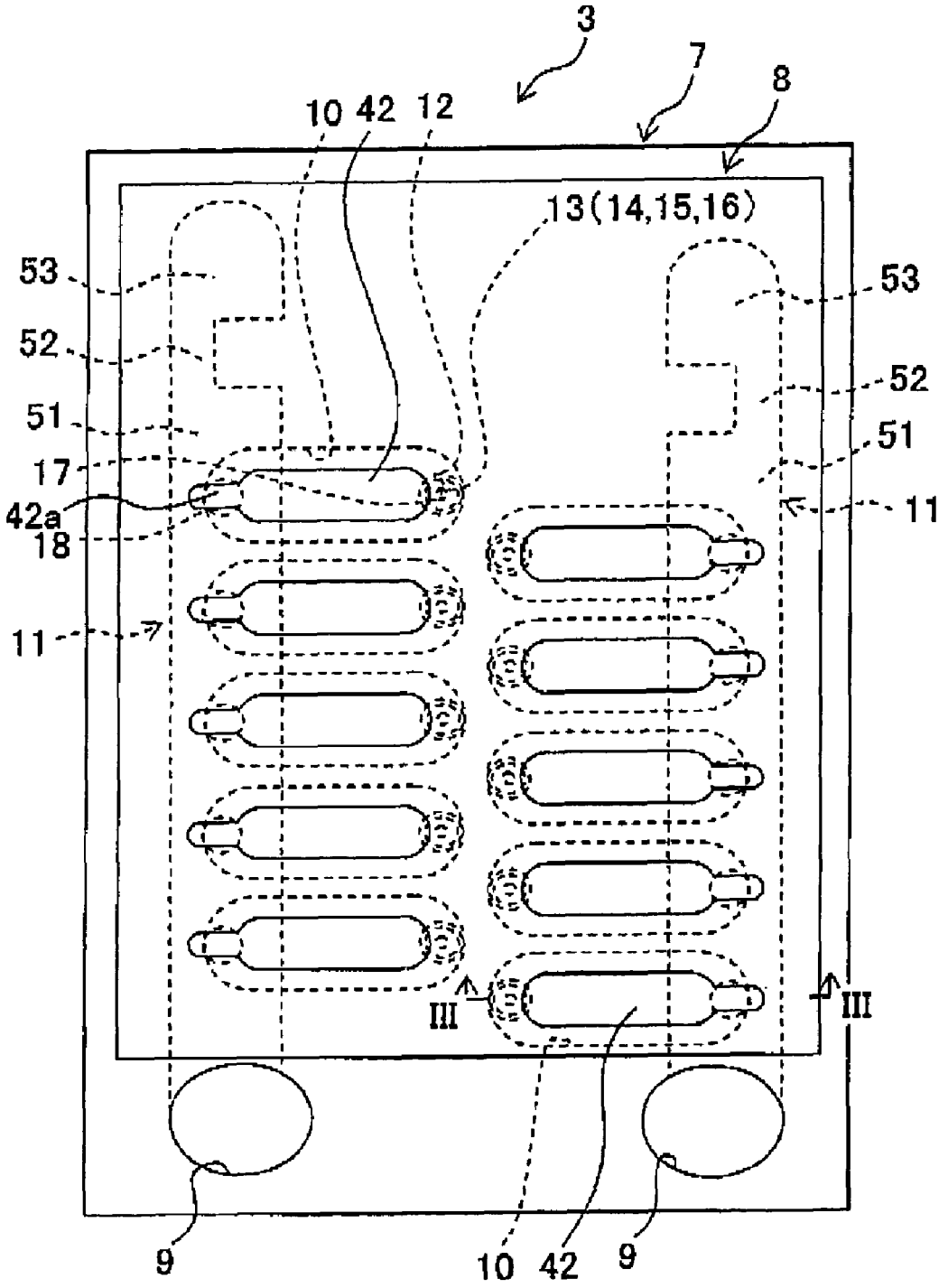
FIG. 2 shows a plan view illustrating an ink-jet head shown in FIG. 1.
Figure 3:
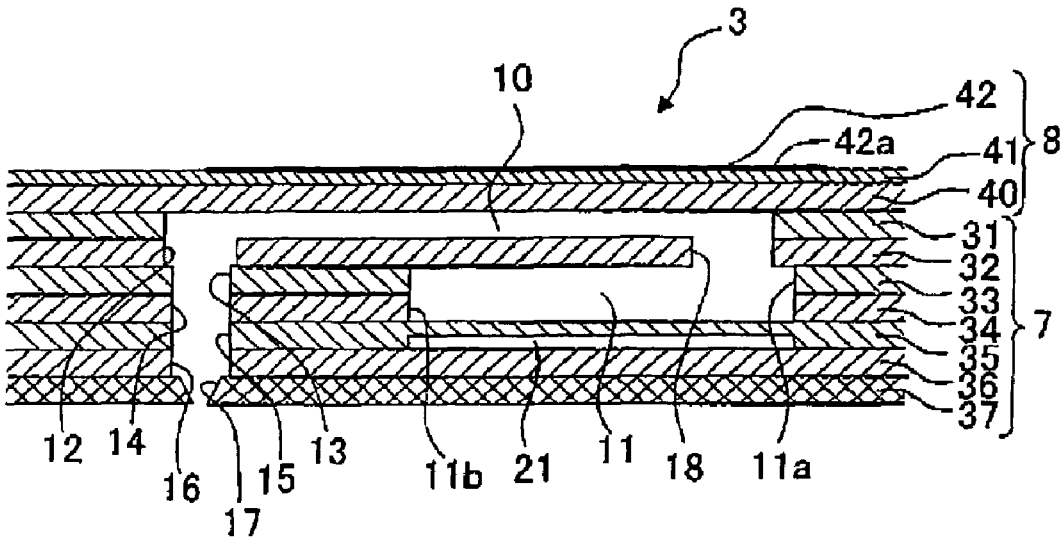
FIG. 3 shows a sectional view taken along a line III-III shown in FIG. 2.

Next, the ink-jet head 3 will be explained with reference to FIGS. 2 and 3. As shown in FIGS. 2 and 3, the ink-jet head 3 includes a flow passage unit (channel unit) 7 having a plurality of individual ink flow passages having a plurality of pressure chambers 10 formed therein, respectively, and a piezoelectric actuator (energy-applying mechanism) 8 which is arranged on the upper surface of the flow passage unit 7 and which applies the pressure to the ink in the pressure chambers 10.

As shown in FIG. 3, the flow passage unit 7 has a cavity plate 31, a base plate 32, two manifold plates 33, 34, a damper plate 35, a spacer plate 36, and a nozzle plate 37. The seven plates 31 to 37 are joined to one another in a stacked state. The six plates 31 to 36, except for the nozzle plate 37, are formed of a metal material such as stainless steel. Holes, which construct the ink flow passages such as manifold flow passages 11 (to be described later on) and the pressure chambers 10 are formed by a method such as the etching. The nozzle plate 37 is formed of a synthetic resin material such as polyimide. The nozzle plate 37 is adhered to the lower surface of the spacer plate 36. The nozzles 17, which correspond to the pressure charters 10 respectively, are formed in the nozzle plate 37 by the laser processing. The nozzle plate 37 may be also formed of a metal material such as stainless steel in the same manner as the other plates 31 to 36.

As shown in FIGS. 2 and 3, the cavity plate 31 has ten pieces of the pressure chambers 10 which are formed therein and are arranged in two rows in the paper feeding direction (up and down direction as viewed in FIG. 2). The shape of each of the pressure chambers 10 is a substantially elliptic shape which is long in the scanning direction (left and right direction as viewed in FIG. 2). Through-holes 12, 18 are formed in the base plate 32 at areas overlapping in a plan view with a portion in the vicinity of the both ends, of one of the pressure chambers 10, in the scanning direction.

Upper and lower half-portions 11*a*, 11*b* of each of the two manifold flow passages 11 are formed in the two manifold plates 33, 34 respectively. The two manifold flow passages 11 are formed by stacking the two manifold plates 33, 34. The manifold flow passages 11 extend in the paper feeding direction. A manifold flow passage 11, which is included in the two manifold flow passages 11 and which is formed on the left side as shown in FIG. 2, is overlapped with the left ends of the five pressure chambers 10 which are arranged on the left side as shown in FIG. 2. A manifold flow passage 11, which is included in the two manifold flow passages 11 and which is formed on the right side as shown in FIG. 2, is overlapped with the right ends of the five pressure chambers 10 which are arranged on the right side as shown in FIG. 2. Ink inflow ports 9 are formed in the flow passage unit 7 at one end thereof in the paper feeding direction (lower side as shown in FIG. 2).

The ink inflow ports 9 are formed in the flow passage unit 7 at an area in which the piezoelectric actuator 8 is not arranged. The ink is supplied to the manifold flow passage 11 via the ink inflow port 9. In this embodiment, one ink inflow port 9 is arranged for each of the manifold flow passages 11.

As shown in FIG. 2, each of the manifold flow passages 11 extends from one of the ink inflow ports 9 in the paper feeding direction. The manifold flow passage 11 has three portions, i.e., a main portion (liquid chamber) 51, a connecting portion (communicating portion, throttle portion) 52, and an extended portion (subsidiary portion, buffer chamber) 53 which are arranged in this order from the upstream side in the paper feeding direction. The main portion 51, which is connected to the ink inflow port 9, has a cross-sectional area (flow passage area) in relation to the direction perpendicular to the extending direction (hereinafter simply referred to as "cross-sectional area") which is constant in the extending direction. The main portions 51 extend in parallel to one another. The connecting portion 52 is connected to the end, of the main portion 51, on the side opposite to the ink inflow port 9, with the pressure chambers 10 intervening therebetween. The connecting portion 52 extends in the paper feeding direction. The width of the connecting portion 52 is smaller than the width of the main portion 51, and the cross-sectional area of the connecting portion 52 is smaller than the cross-sectional area of the main portion 51. The extended portion 53 is connected to the end, of the connecting portion 52, on the side opposite to the main portion 51. The extended portion 53 extends in the paper feeding direction. The cross-sectional area of the extended portion 53 is the same as the cross-sectional area of the main portion 51. Further, connecting ports (communication holes 18) to make connection with the individual ink flow passages (to be described later on) are formed only in the main portion 51. The cross-sectional areas of the main portion 51 and the extended portion 53 are about 12.5 times the cross-sectional area of the connecting portion 52. The areas 51 to 53 are formed such that parts of the wall surface defining the manifold flow passage 11 are protruded inwardly into the manifold flow passage 11. The protruding portion of the wall surface (protruding wall surface portion) defines the connecting portion 52. The main portion 51 and the extended portion 53 are defined on the both sides respectively, of the connecting portion 52, with the connecting portion 52 intervening therebetween. When the manifold flow passage 11 is formed to have such a shape, the pressure wave can be efficiently attenuated in the manifold flow passage 11 as described later on. Such an effect of the attenuation, which is exerted on the pressure wave, is affected by the presence and the size of the connecting portion 52. As described later on, it is desirable to form the manifold flow passage 11 so that the cross-sectional areas of the main portion 51 and the extended portion 53 are 12 to 13 times the cross-sectional area of the connecting portion. Communication holes 13, 14 are formed in the manifold plates 33, 34 at positions each overlapping in a plan view with one of the communication holes 12.

A recess 21, which is open downwardly in FIG. 3, is formed in the damper plate 35 in a portion facing the manifold flow passage 11. The portion of the damper plate 35, in which the recess 21 is formed, has a small or decreased thickness. This portion is provided as a thin-walled portion. Accordingly, the portion of the damper plate 35, on which the recess 21 is formed, functions as a damper to attenuate the pressure wave. A communication hole 15 is formed in the damper plate 35 at a position at which the communication hole 15 is overlapped in a plan view with one of the communication holes 14. The spacer plate 36 covers the opening of the recess 21 of the damper plate 35. A plurality of communication holes 16 are formed in the spacer plate 36 at positions at each of which one of the communication holes 16 is overlapped in a plan view with one of the communication holes 15.

The nozzles 17 are formed in the nozzle plate 37 at positions at which the nozzles 17 are overlapped in a plan view with the communication holes 16, respectively. When the nozzle plate 37 is formed of a synthetic resin material, the nozzles 17 can be formed by the excimer laser processing. When the nozzle plate 37 is formed of a metal material, the nozzles 17 can be formed by the press working by using a punch.

The manifold flow passage 11 is communicated with the pressure chambers 10 via the communication holes 18, respectively. Each of the pressure chambers 10 is communicated with one of the nozzles 17 via the communication holes 12 to 16. A plurality of individual ink flow passages are formed in the flow passage unit 7 as described above, each of which ranges from the outlet of one of the manifold flow passages 11 via one of the pressure chambers 10 to arrive at one of the nozzles 17.

Next, the piezoelectric actuator 8 will be explained. The piezoelectric actuator 8 includes a vibration plate 40 which is arranged on the upper surface of the flow passage unit 7, a piezoelectric layer 41 which is formed on the upper surface of the vibration plate 40, and a plurality of individual electrodes 42 which are formed on the upper surface of the piezoelectric layer 41 corresponding to the pressure chambers 10 respectively.

The vibration plate 40 is a metal plate having a substantially rectangular shape in a plan view. For example, the vibration plate 40 is formed of iron-based alloy such as stainless steel, copper-based alloy, nickel-based alloy, or titanium-based alloy. The vibration plate 40 is arranged on the upper surface of the cavity plate 31 to cover the pressure chambers 10 therewith. The vibration plate 40 is joined to the cavity plate 31. The vibration plate 40 made of metal is conductive, and serves also as a common electrode to make the electric field to act in portions of the piezoelectric layer 41 each interposed between the vibration plate 40 and one of the individual electrodes 42. The vibration plate 40 is always kept at the ground electric potential. When the vibration plate 40 is formed of an insulating material such as ceramic, a common electrode is provided on the upper surface of the vibration plate 40. Accordingly, it is possible to apply the electric field to the portions of the piezoelectric layer 41 each interposed between the common electrode and one of the individual electrodes 42 in the same manner as in this embodiment.

As shown in FIG. 3, the piezoelectric layer 41 is arranged on the upper surface of the vibration plate 40. The piezoelectric layer 41 is mainly composed of lead titanate zirconate (PZT) which is a solid solution of lead titanate and lead zirconate and which is ferroelectric. The piezoelectric layer 41 is formed continuously in a form of sheet over the plurality of pressure chambers 10. The piezoelectric layer 41 can be formed, for example, by an aerosol deposition (AD method) in which extremely minute particles of a piezoelectric material are sprayed or jetted and collided at a high velocity onto a substrate so as to make the particles deposit on the substrate. Alternatively, the piezoelectric layer 41 can be also formed by a sputtering method, a chemical vapor deposition (CVD method), a sol-gel method, a hydrothermal synthesis method, or the like. Further alternatively, the piezoelectric layer 41 can be also formed as follows. That is, a piezoelectric sheet, which is formed by sintering a green sheet of PZT, is cut into a predetermined size to be stuck to the upper surface of the vibration plate 40.

The individual electrodes 42, which are substantially elliptic and smaller to some extent than the pressure chambers 10 as a whole, are formed on the upper surface of the piezoelectric layer 41 at positions at which the individual electrodes 42 overlap in a plan view with the pressure chambers 10, respectively. Each of the individual electrodes 42 is formed of a conductive material such as gold, copper, silver, palladium, platinum, or titanium. One end, of the individual electrode 42, in the longitudinal direction extends in the longitudinal direction of the individual electrode 42 to an area which is not overlapped in a plan view with any of the pressure chambers 10. The extending portion of the individual electrode 42 forms a contact 42*a*. The individual electrodes 42 and the contacts 42*a* can be formed by the screen printing, the sputtering method, or the vapor deposition method.

An unillustrated flexible printed circuit board (FPC) is arranged on the upper surface of the piezoelectric actuator 8. The contacts 42*a* are connected to an unillustrated driver IC via signal lines of the FPC. The electric potential of each of the individual electrodes 42 is controlled by the driver IC. A ground line of the FPC is also connected to the common electrode which is kept at the ground electric potential.

Next, an explanation will be made about the operation of the ink-jet head 3. When the predetermined electric potential is selectively applied to the individual electrodes 42 by the unillustrated driver IC, then the difference in electric potential is generated between a certain individual electrode 42 to which the predetermined electric potential is applied and the vibration plate 40 which serves as the common electrode, and the electric field is generated in the thickness direction in a portion of the piezoelectric layer 42, interposed therebetween. At this time, when the direction of polarization of the piezoelectric layer 41 is the same as the direction of the electric field, the piezoelectric layer 41 is contracted in the left and right direction perpendicular to the thickness direction. The vibration plate 40 functions to restrict the contraction of the piezoelectric layer 41. The portion, of the vibration plate 40, which corresponds to the selected certain individual electrode 42, is deformed to project toward a pressure chamber 10, corresponding to the selected individual electrode 42, in accordance with the contraction of the piezoelectric layer 41, so as to reduce the volume of the pressure chamber 10. Accordingly, the pressure of the ink in the pressure chamber 10 is increased (discharge energy is applied to the ink in the pressure chamber 10), and the ink is jetted from a nozzle 17 communicated with the pressure chamber 10.

In this situation, the pressure wave is generated in the pressure chamber 10 in accordance with the increase in the pressure in the pressure chamber 10. A part of the pressure wave is also propagated to the manifold flow passage 11 communicated with the pressure chamber 10. In the manifold flow passage 11, the pressure wave is firstly propagated to the main portion 51 communicated with the pressure chamber 10, and the pressure wave is further propagated to the connecting portion 52 communicated with the main portion 51. The width and the cross-sectional area of the connecting portion 52 are smaller than the width and the cross-sectional area of the main portion 51. Therefore, a part of the pressure wave propagated to the connecting portion 51 passes through the connecting portion 52, and another part of the pressure wave is reflected by the connecting portion 52, That is, a part of the pressure wave is propagated to the extended portion 53 via the connecting portion 51; and a part of the pressure wave is reflected at the boundary between the main portion 51 and the connecting portion 51, which is then propagated through the main portion 51 toward the ink inflow port 9 again. Further, the pressure wave, which is partially propagated to the extended portion 531 is reflected at the end of the extended portion 53 on the side opposite to the connecting portion 52, and the reflected pressure wave arrives at the connecting portion 52 again. Also in this situation, the width and the cross-sectional area of the connecting portion 52 are smaller than the width and the cross-sectional area of the extended portion 53. Therefore, a part of the arrived pressure wave is propagated to the main portion 51 via the connecting portion 52; and another part of the arrived pressure wave is reflected at the boundary between the extended portion 53 and the connecting portion 52, which is then propagated toward the extended portion 53 again.

As described above, when the pressure wave arrives at the connecting portion 52, the phenomenon is repeated such that a part of the pressure wave is propagated through the connecting portion 52, and a part of the remaining part is reflected at the boundary between the main portion 51 and the connecting portion 52 or at the boundary between the extended portion 53 and the connecting portion 52. As a whole, a part of the pressure wave, which is propagated from the pressure chamber 10 to the main portion 51, is attenuated in the connecting portion 52 and the extended portion 53, and is not returned to the main portion 51 again. Therefore, the pressure wave is efficiently attenuated in the manifold flow passage 11. In this situation, the portion of the damper plate 35, at which the recess 21 is formed, also functions as the damper to attenuate the pressure wave in the manifold flow passage 11.

Figure 4:
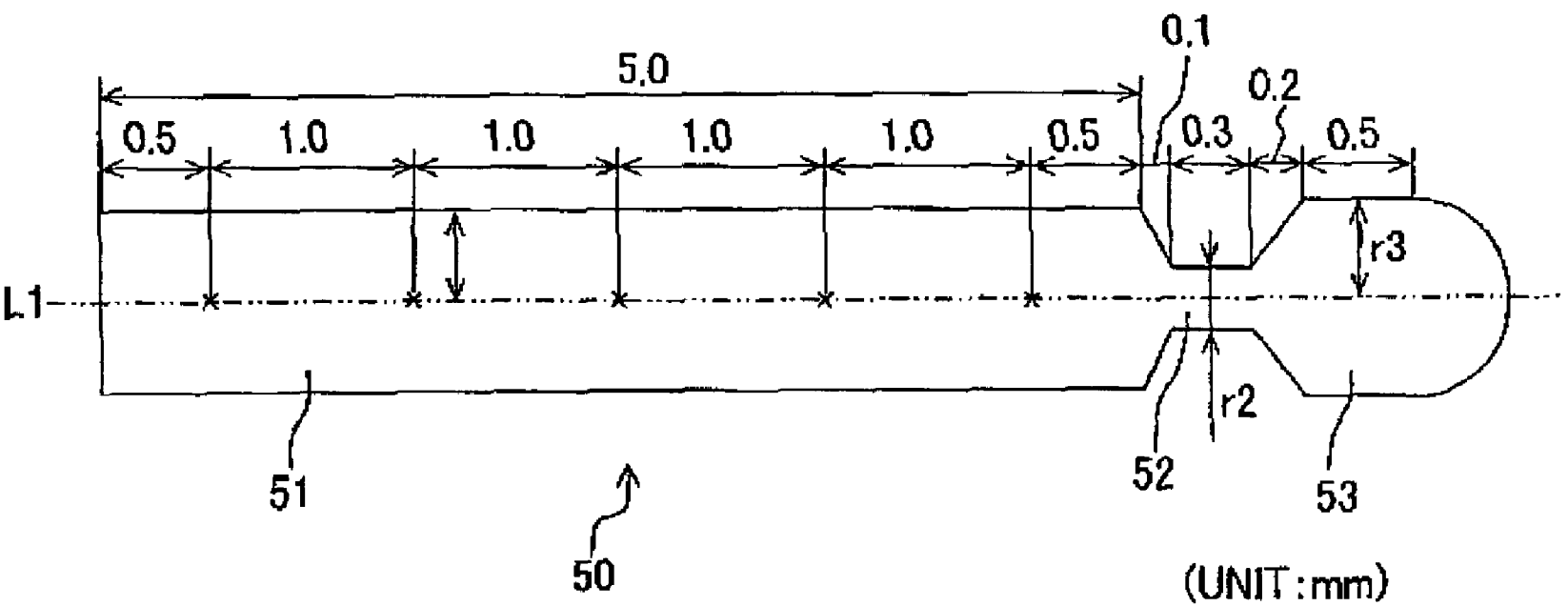
FIG. 4 shows a simulation model corresponding to a manifold flow passage shown in FIG. 2.

An explanation will now be made about the relationship between the effect to attenuate the pressure wave and the cross-sectional areas of the main portion 51, the connecting portion 52, and the extended portion 53 of the manifold flow passage 11. In order to investigate the relationship between the effect to attenuate the pressure wave and the main portion 51, the connecting portion 52, and the extended portion 53, a simulation model of the manifold flow passage 50 is considered as shown in FIG. 4. FIG. 4 shows a cross-sectional shape of the manifold flow passage 50. The shape of the manifold flow passage 50 is a cylindrical shape as obtained by rotating the plane of FIG. 4 about the center of the axis L1 (rotational symmetry axis) shown in FIG. 4. The manifold flow passage 50 has three areas having radii of r1, r2, r3 respectively. An area having the radius of r1 is the main portion 51, an area having the radius of r2 is the connecting portion 52, and an area having the radius of r3 is the extended portion 53. The lengths of the main portion 51, the connecting portion 52, and the extended portion 53 in the direction perpendicular to the radius are 5.0 mm, 0.3 mm, and 0.5 mm respectively. The lengths of the area between the main portion 51 and the connecting portion 52 and the area between the connecting portion 52 and the extended portion 53 in the direction perpendicular to the radius are 0.1 mm and 0.2 mm respectively.

In the simulation model as described above, it is assumed that the main portion 51, the connecting portion 52, and the extended portion 53 have the pressure of 0.1 MPa in the initial state. On this assumption, the time-dependent change of the pressure is calculated at five measuring points P1 to P5 in the main portion 51 as shown in FIG. 4 when a pressure of 0.2 MPa is applied to the left end of the main portion 51. An integral value is calculated for each of the measuring points as follows. That is, the final pressure value of 0.2 MPa in the manifold flow passage 11 is subtracted from the calculated pressure value to obtain a value. The value is squared and integrated in relation to the time to obtain the integral value. Further, a value (sum of squares) is calculated, which is obtained by totalizing the integral values calculated at the measuring points P1 to P5. The measuring points P1 to P5 are aligned in this order from the left side of the main portion 51 in the direction perpendicular to the radius as shown in FIG. 4. A distance between the measuring point P1 and the left end of the main portion 51 and a distance between the measuring point PS and the right end of the main portion 51 are 0.5 mm. A distance between the adjoining measuring points is 1.0 mm. The sum of squares reflects the pressure fluctuation with respect to the final pressure value (0.2 MPa) at each of the measuring points. As the pressure fluctuation at each of the measuring points is smaller, the value of the sum of squares becomes smaller. Therefore, it is affirmed that as the value of the sum of squares is smaller, the pressure wave is attenuated more efficiently. In this simulation, it is assumed that the density of the ink in the manifold flow passage 50 is 1,050 $kg/m^3$, the viscosity of the ink is 3 mPa·s, and the velocity of sound in the ink is 1,300 m/s.

In this simulation, the sum of squares was calculated while changing the value of r2 in the cases of (a) r1=0.3 mm, r3=0.54 mm, (b) r1=0.3 mm, r3=0.35 mm, (c) r1=r3=0.3 mm, and (d) r1=0.3 mm, r3=0.25 mm respectively. Obtained results are shown in Tables 1 to 4 respectively.

TABLE 1

| r2 [mm] (r1 = 0.3, r3 = 0.54) | Sum of squares |
|---|---|
| 0.10 | 1.42 |
| 0.12 | 1.14 |
| 0.14 | 1.03 |
| 0.15 | 1.02 |
| 0.16 | 1.03 |
| 0.18 | 1.08 |
| 0.20 | 1.16 |

TABLE 2

| r2 [mm] (r1 = 0.3, r3 = 0.35) | Sum of squares |
|---|---|
| 0.08 | 2.75 |
| 0.09 | 2.55 |
| 0.10 | 2.48 |
| 0.11 | 2.51 |
| 0.15 | 3.15 |

TABLE 3

| r2 [mm] (r1 = 0.3, r3 = 0.3) | Sum of squares |
|---|---|
| 0.07 | 3.59 |
| 0.08 | 3.41 |
| 0.09 | 3.39 |
| 0.10 | 3.50 |
| 0.12 | 3.93 |

TABLE 4

| r2 [mm] (r1 = 0.3, r3 = 0.25) | Sum of squares |
|---|---|
| 0.06 | 4.55 |
| 0.07 | 4.39 |
| 0.08 | 4.42 |
| 0.09 | 4.61 |
| 0.10 | 4.88 |

The following fact is appreciated. That is, the value of the sum of squares is minimized when r2=0.15 mm is satisfied in the case of (a) r1=0.3 mm, r3=0.54 mm according to the result shown in Table 1, when r2=0.10 mm is satisfied in the case of (b) r1=0.3 mm, r3=0.35 mm according to the result shown in Table 2, when r2 is a value within a range of $0.08 \leqq r2 \leqq 0.09$ (for example, 0.085 mm) in the case of (c) r1=r3=0.3 mm according to the result shown in Table 3, and when r2=0.07 mm is satisfied in the case of (d) r1=0.3 mm, r3=0.25 mm according to the result shown in Table 4, respectively.

In these cases, the cross-sectional area of the extended portion 53 is (a) 13.0 ($=0.54^2/0.15^2$) times the cross-sectional area of the connecting portion 52; (b) 12.3 ($=0.35^2/0.10^2$) times the cross-sectional area of the connecting portion 52; (c) 12.5 ($=0.3^2/0.85^2$) times the cross-sectional area of the connecting portion 52; and (d) 12.8 ($=0.25^2/0.07^2$) times the cross-sectional area of the connecting portion 52, respectively. According to these results, it is appreciated that the pressure wave can be attenuated most efficiently when the cross-sectional area of the extended portion 53 is 12 to 13 times the cross-sectional area of the connecting portion 52. In this embodiment, the cross-sectional area, which relates to the extending direction of the main portion 51 and the extended portion 53 shown in FIG. 2, is about 12.5 times the cross-sectional area which relates to the extending direction of the connecting portion 52, on the basis of the simulation result obtained when r1 and r3 have the same value.

According to the embodiment explained above, the manifold flow passage 11 includes the main portion 51, the connecting portion 52, and the extended portion 53 which extend in the arrangement direction of the pressure chambers 10. The cross-sectional area of the connecting portion 52 is smaller than the cross-sectional areas of the main portion 51 and the extended portion 53. In other words, the manifold flow passage 11 includes the liquid chamber (main portion) 51, the buffer chamber (extended portion) 53, and the communicating portion (connecting portion, throttle portion) 52 which makes liquid communication between the liquid chamber and the buffer chamber. The flow passage area of the communicating portion is narrower than the flow passage areas of the liquid chamber and the buffer chamber. Further, in other words, the manifold flow passage 11 has the throttle portion 52 which is formed in the flow passage at an intermediate position thereof and which has the flow passage area suddenly narrowed, and thus the liquid chamber 51 and the buffer chamber 53 are formed on the both sides of the throttle portion. When the pressure wave in the manifold flow passage 11 arrives at the connecting portion 52 from the main portion 51, then a part of the pressure wave is propagated through the connecting portion 51, and another part of the pressure wave is reflected at the boundary between the main portion 51 and the connecting portion 52. Further, the pressure wave, which is partially propagated from the connecting portion 52 to the extended portion 53, is reflected at the extended portion 53. When the pressure wave arrives at the connecting portion 52, then a part of the pressure wave is propagated through the connecting portion 52, and another part of the pressure wave is reflected at the boundary between the extended portion 53 and the connecting portion 52. The phenomenon as described above is repeated, thereby making it possible to effectively attenuate the pressure wave in the manifold flow passage 11. That is, when the manifold flow passage 11 is provided with the extended portion (buffer chamber) 53 and the connecting portion (throttle portion) 52, then they function as a damper, and it is possible to attenuate the pressure wave efficiently.

The wall surface, which defines the manifold flow passage 11, partially protrudes. The connecting portion 52 is defined by the protruding portion of the wall surface, and portions, of the wall surface, on the both sides of the connecting portion 52 are the main portion 51 and the extended portion 53.

Therefore, the main portion 51, the connecting portion 52, and the extended portion 53 can be formed with ease by making the wall surface of the manifold flow passage 11 to protrude partially.

Further, the cross-sectional area of the extended portion 53 is 12.5 times the cross-sectional area of the connecting portion 52. Therefore, it is possible to efficiently attenuate the pressure wave.

Next, modifications of the embodiment will be explained, in which various changes are made to the embodiment of the present invention. However, parts or components, which are constructed in the same manner as those of the embodiment of the present invention, are designated by the same reference numerals, any explanation of which will be appropriately omitted.

First Modification

Figure 5:
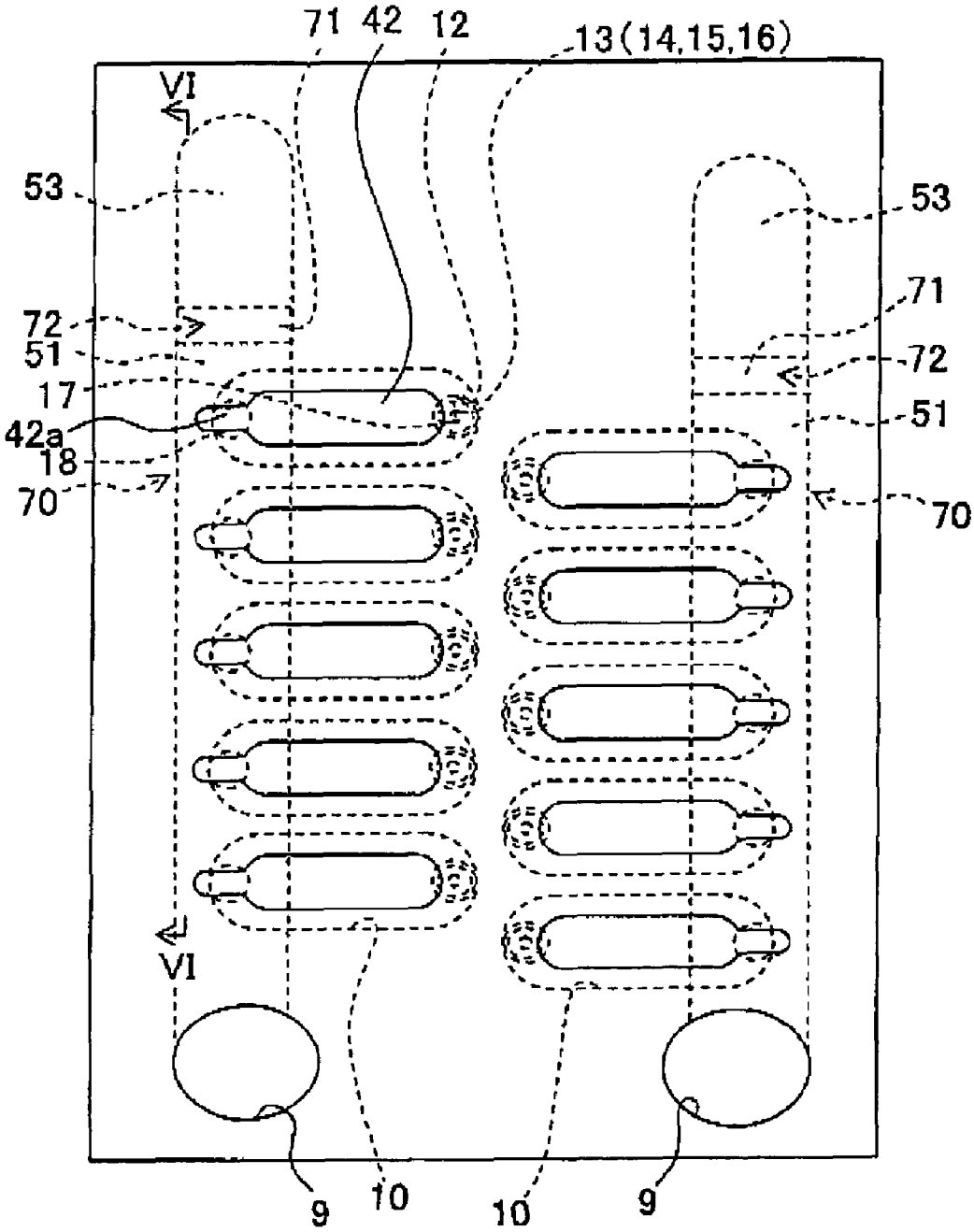
FIG. 5 shows a plan view illustrating a first modification as corresponding to FIG. 2.
Figure 6:
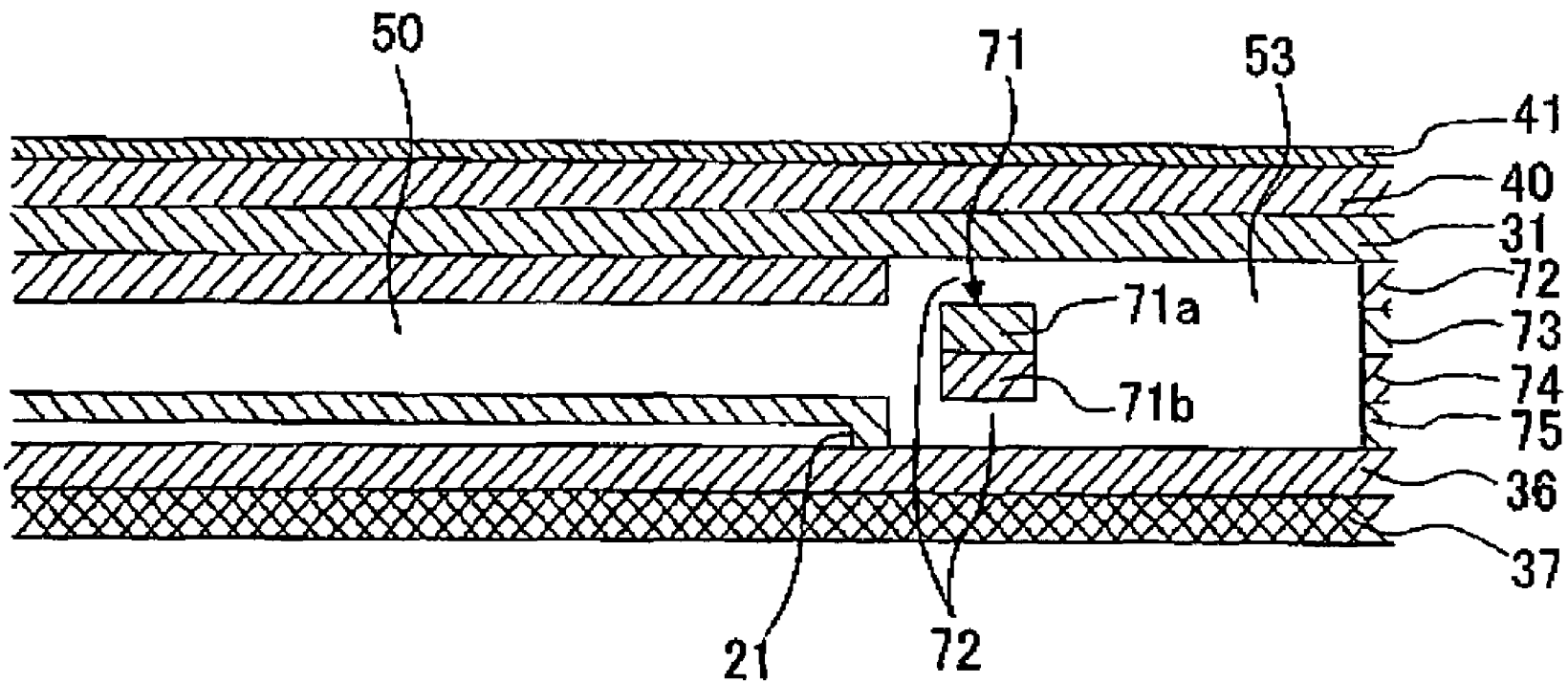
FIG. 6 shows a sectional view taken along a line VI-VI shown in FIG. 5.

As shown in FIGS. 5 and 6, it is also allowable that a bridge 71, which extends in the scanning direction (left and right direction in FIG. 5), is formed in a manifold flow passage 70, and both ends of the bridge 71 are supported by side walls which define the manifold flow passage 70. The bridge 71 is formed by joining an upper portion 71*a* and a lower portion 71*b* of the bridge 71 formed in the two manifold plates 73, 74 respectively. In this case, as shown in FIG. 6, portions of the manifold flow passage 70 are formed in a base plate 72 and a damper plate 75 at areas overlapped in a plan view with the bridge 71. Portions, which have a small cross-sectional area defined as a result of the formation of the bridge 71 of the manifold flow passage 70, functions as a connecting portion 72.

Second Modification

Figure 7:
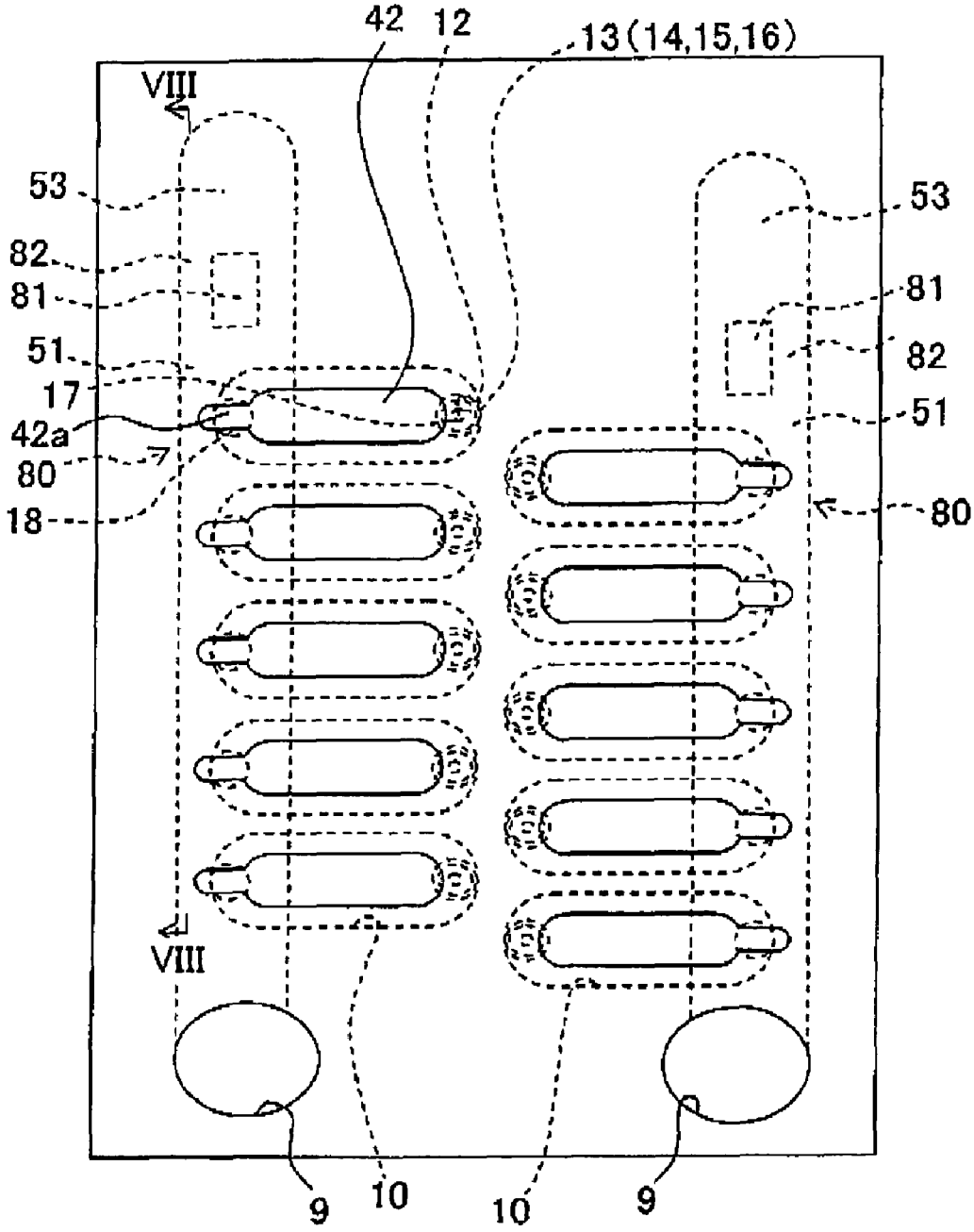
FIG. 7 shows a plan view illustrating a second modification as corresponding to FIG. 2.
Figure 8:
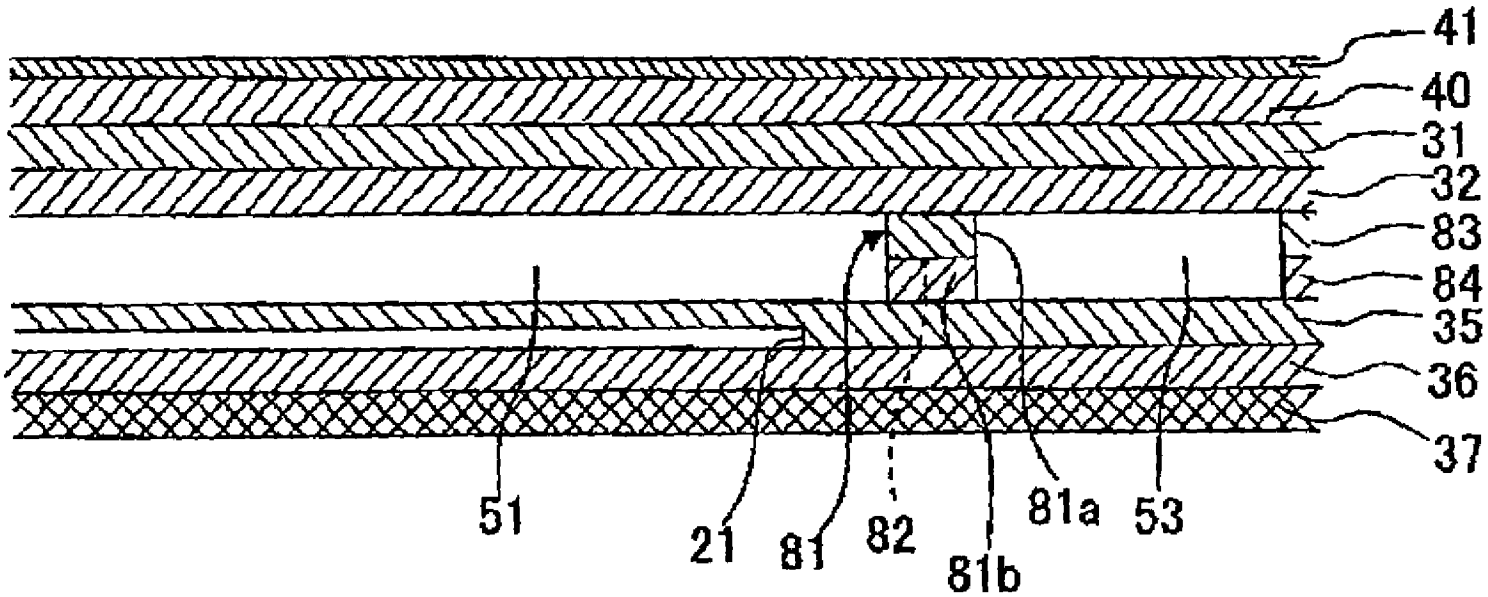
FIG. 8 shows a sectional view taken along a line VIII-VIII shown in FIG. 7.

As shown in FIGS. 7 and 8, it is also allowable that a bridge 81, which has both ends supported by upper and lower wall surfaces defining a manifold flow passage 80, is formed, and a portion, which has a small cross-sectional area defined as a result of the formation of the bridge 81 of the manifold flow passage 80, is provided as a connecting portion 82. As shown in FIG. 8, the bridge 81 is formed by joining an upper portion 81*a* and a lower portion 81*b* of the bridge 81 formed in two manifold plates 83, 84 respectively, by joining the manifold plates 83, 84.

Third Modification

Figure 9:
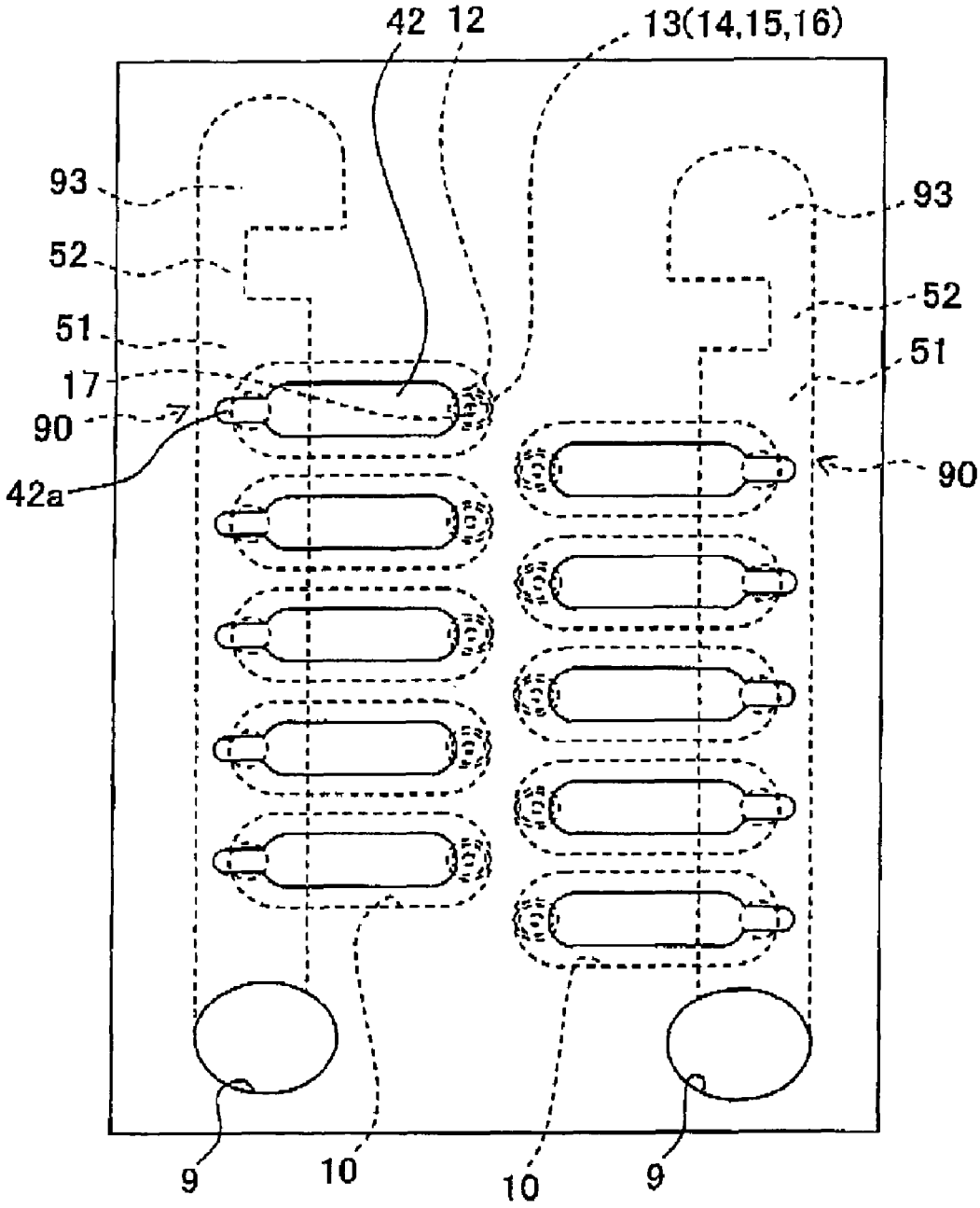
FIG. 9 shows a plan view illustrating a third modification as corresponding to FIG. 2.

As shown in FIG. 9, it is also allowable that the width of an extended portion 93 is greater than the width of a main portion 51. In this case, the cross-sectional area of the extended portion 93 is greater than the cross-sectional area of the main portion 51. Therefore, as shown in the simulation result as well, it is possible to efficiently attenuate the pressure wave by the extended portion 93.

Fourth Modification

Figure 10:
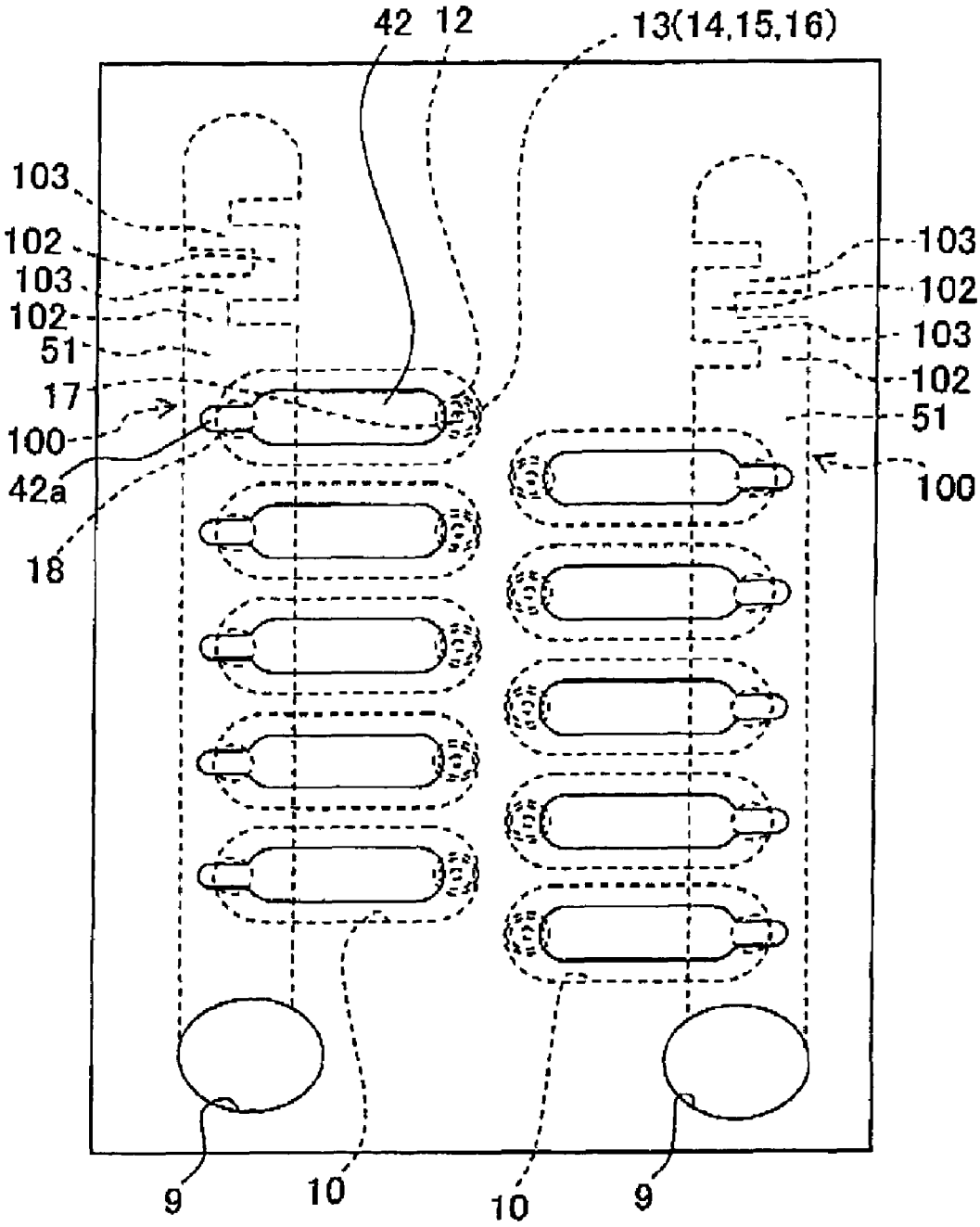
FIG. 10 shows a plan view illustrating a fourth modification as corresponding to FIG. 2.

As shown in FIG. 10, it is also allowable that two connecting portions (connecting sub-portions) 102 and two extended portions (extended sub-portions) 103 are alternately formed in the arrangement direction of the plurality of pressure chambers 10 (up and down direction as viewed in FIG. 10). In this case, the pressure wave is propagated through the main portion 51 and each of the extended portions 103 to arrive at each of the connecting portions 102. A part of the pressure wave is propagated through the connecting portion 102, and another part of the pressure wave is reflected. Accordingly, the pressure wave can be attenuated efficiently in a manifold 100. The numbers of the connecting portions and the extended portions are not limited to two, which may be not less than three respectively.

Fifth Modification

Figure 11:
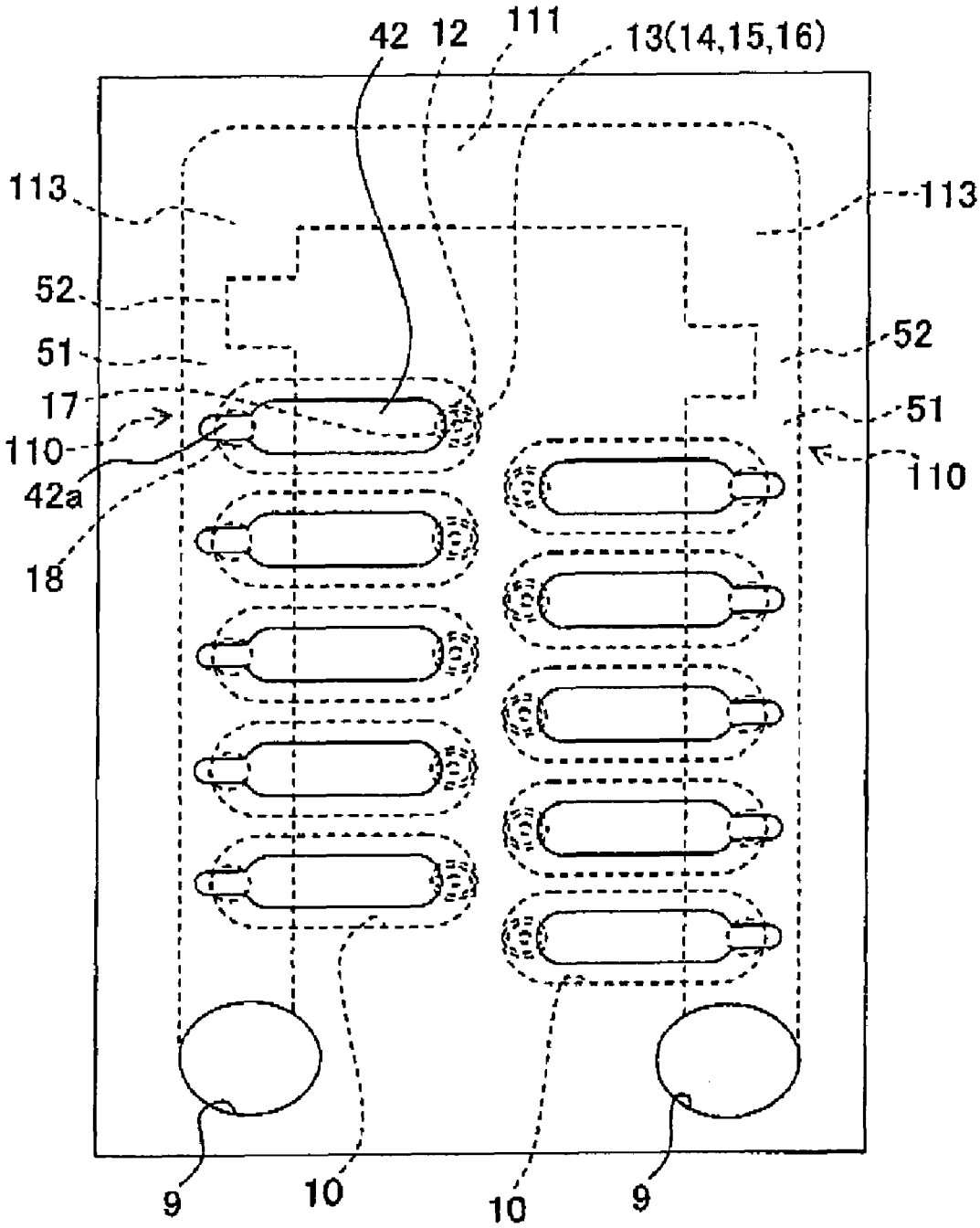
FIG. 11 shows a plan view illustrating a fifth modification as corresponding to FIG. 2.

As shown in FIG. 11, it is also allowable that a linking portion 111 is formed, which extends in a direction (left and right direction as viewed in FIG. 11, fourth direction) perpendicular to the arrangement direction of the pressure chambers 10, which has a cross-sectional area greater than a cross-sectional area of extended portions 113, and which connects an extended portion 113 of one of the manifold flow passage 110 to another extended portion 113 belonging to another manifold flow passage 110 adjacent to the manifold flow passage 110 (first liquid chamber and second liquid chamber). In this case, the linking portion 111, which links or connects the adjoining manifold flow passages 110, is formed. Therefore, the pressure wave generated in one of the manifold flow passages 110 can be propagated to the extended portion 113 of another manifold flow passage 110 adjacent thereto, via the linking portion 111. Accordingly, the pressure wave can be attenuated also in the extended portion 113 of the adjacent manifold flow passage 110. The pressure wave can be attenuated more efficiently. Further, since the cross-sectional area of the linking portion 111 is greater than the cross-sectional area of the extended portion 113, the pressure wave is easily propagated from the extended portion 113 to the linking portion 111; and the volume of the linking portion 111 is increased. Therefore, the pressure wave can be efficiently attenuated in the extended portion 113 and the linking portion 111.

The piezoelectric actuator 8 used in the embodiment of the present invention is formed with the piezoelectric layer 14 which is interposed between a single pair of electrodes (individual electrode and common electrode) on the vibration plate 40. However, the piezoelectric actuator to be used for the present invention is not limited to the form of the piezoelectric actuator 8 as described above.

Figure 12A:
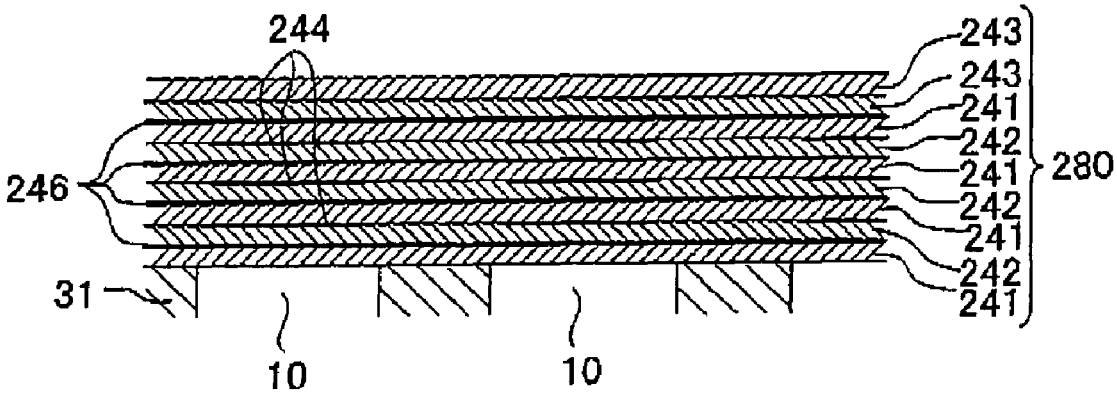
FIG. 12A shows a first modification of a piezoelectric actuator.

A first modification of the piezoelectric actuator is shown in FIG. 12A. It is also allowable that a piezoelectric actuator 280 shown in FIG. 12A includes a stack having a plurality of piezoelectric layers (individual piezoelectric layers) stacked on the upper surface of the cavity plate 31, wherein each of the piezoelectric layers is interposed between a pair of electrodes. The stack is provided with three sets of the piezoelectric layers. Each of the piezoelectric layer sets includes a piezoelectric layer 241 which has a common electrode 246 formed on a surface thereof on a side opposite to the pressure chamber 10, and a piezoelectric layer 242 which is arranged on an upper surface of the piezoelectric layer 241 and which has individual electrodes 244 formed on a surface on a side opposite to the pressure chambers 10 at areas facing the pressure chambers 10. The piezoelectric actuator 280 further includes two layers of piezoelectric layers 243 on which no electrode is formed and one layer of piezoelectric layer 241. These piezoelectric layers 241, 243 are arranged on the other surface of the three piezoelectric layer sets. The respective piezoelectric layers 241, 242 are polarized in the stacking direction. When the voltage is applied between a common electrode 246 and an individual electrode 244 in the piezoelectric actuator 280, portions of the piezoelectric layers 241, 242 interposed between the both electrodes are expanded in the stacking direction. Accordingly, the volume is changed in a pressure chamber 10 corresponding to the individual electrode 244 to which the voltage is applied. When the common electrodes 246 and the individual electrodes 244 are connected to a wiring member such as FPC, the following arrangement is allowable. That is, wirings, which are led or drawn from target individual electrodes 244 and common electrodes 246, are electrically led to a surface of the uppermost layer via through-holes communicated with the uppermost layer, and the wirings are connected to the FPC on the surface of the uppermost layer. Accordingly, the individual electrodes 244 and the common electrodes 246 can be electrically connected to the FPC with ease.

Figure 12B:
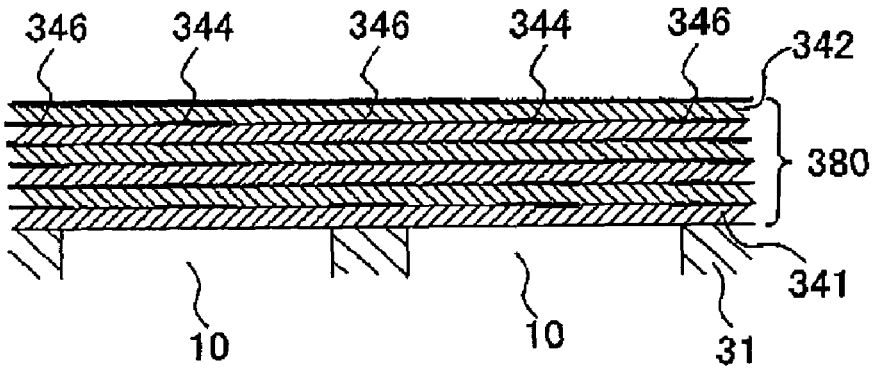
FIG. 12B shows a second modification of a piezoelectric actuator.

A second modification of the piezoelectric actuator is shown in FIG. 12B. A piezoelectric actuator 380 shown in FIG. 12B is provided with five piezoelectric layers 341 arranged on the upper surface of the cavity plate 31, and one piezoelectric layer 342 arranged on the uppermost layer of the five piezoelectric layers 341. Common electrodes 346 and individual electrodes 344 are formed on the surface, of each of the piezoelectric layers 341, on the side opposite to the pressure chambers 10. However, no electrode is formed on the piezoelectric layer 342. The individual electrodes 344 are formed to face one of the pressure chambers 10. The common electrodes 346 are formed to face a column defining the pressure chambers 10. When a predetermined voltage is applied between an individual electrode 344 and two common electrodes 346 in the piezoelectric actuator 380, a portion of the piezoelectric layer 341, which is interposed by the selected individual electrode 344 and the two common electrodes 346 adjacent to the individual electrode 344, causes the so-called thickness slip displacement. Accordingly, the portion of the piezoelectric actuator 380 facing one of the pressure chambers 10 is displaced to change the volume of the pressure chamber 10. When the common electrodes 346 and the individual electrodes 344 are connected to a wiring member such as FPC, the following arrangement is allowable. That is, the wirings, which are led from the target individual electrodes 344 and common electrodes 346, are electrically led to the surface of the uppermost layer via through-holes communicated with the uppermost layer, and the wirings are connected to the FPC on the surface of the uppermost layer. Accordingly, the individual electrodes 344 and the common electrodes 346 can be electrically connected to the FPC with ease. In the piezoelectric actuators shown in FIGS. 12A and 12B, any one of the number of the piezoelectric layer or layers formed with the electrode and the number of the piezoelectric layer or layers formed with no electrode may be arbitrary. The connection between the wiring member such as FPC and the individual electrode and the common electrode is not limited to the examples described above, which may be arbitrary.

In the embodiment of the present invention, the manifold flow passage 11 extends substantially linearly in the paper feeding direction. However, the manifold flow passage 11 is not limited to such a form. For example, as for the wall surface defining the main portion 51, it is not necessarily indispensable that a pair of mutually opposing wall surface portions are parallel to each other. At least one wall surface portion may be curved, provided that the cross-sectional area is substantially constant. The extended portion 53 and/or the connecting portion 52 connected to the main portion 51 may intersect the paper feeding direction. For example, the connecting portion 52 and/or the extended portion 53 may be gradually curved toward the central portion of the flow passage unit 7 from one end of the main portion. In this case, the length of the flow passage unit 7 in the paper feeding direction can be shortened by an amount corresponding to the curvature of the manifold flow passage 11. It is allowable to arbitrarily set the direction (first direction) in which the main portion 51 extends, the direction (second direction) in which the connecting portion 52 extends, the direction (third direction) in which the extended portion 53 extends, and the direction (fourth direction) in which the linking portion extends. For example, all of the directions may be identical with each other, or the directions may be different from each other.

In the embodiment of the present invention, the ink inflow port is formed in the main portion on the side thereof opposite to the connecting portion, with the pressure chamber intervening therebetween. However, the position, at which the ink inflow port is formed, is not limited thereto, which may be arbitrary. It is not necessarily indispensable that the arrangement direction of the pressure chambers is coincident with the direction in which the main portion of the common liquid chamber extends. It is also allowable that the cross-sectional area of the main portion is not uniform. For example, the cross-sectional area may be gradually increased toward the connecting portion provided that any portion, at which the flow passage area is suddenly narrowed, is not formed. On the contrary, the cross-sectional area may be gradually decreased toward the connecting portion. The embodiment of the present invention has been explained as exemplified by the serial type ink-jet printer by way of example. However, the ink-jet printer of the present invention is not limited to those of the serial type. The present invention is also applicable to any ink-jet printer of the line type. The explanation has been made as exemplified by the piezoelectric actuator by way of example as the energy-applying mechanism to be used for the present invention. However, the energy-applying mechanism is not limited thereto. For example, it is also allowable to adopt an energy-applying mechanism based on the so-called bubble-jet system in which the thermal energy is applied to the ink by the aid of a heater such as a heating wire. The liquid droplet-jetting apparatus of the present invention is not limited to the ink-jet head which jets the ink from the nozzles. The present invention is also applicable to any liquid droplet-jetting apparatus other than the ink-jet head, which jets various liquids other than the ink, including, for example, reagent, biological solution, solution for wiring material, solution for electronic material, cooling medium, liquid fuel, and the like.

What is claimed is:

1. A liquid droplet-jetting apparatus which jets a droplet of a liquid, the liquid droplet-jetting apparatus comprising:

a flow passage unit which includes a plurality of pressure chambers arranged along a plane, a plurality of nozzles communicated with the pressure chambers, respectively, and a common liquid chamber communicated with the pressure chambers; and an energy-applying mechanism which applies discharge energy to the liquid in the pressure chambers, wherein the common liquid chamber includes:

an inflow port into which the liquid to be supplied to the pressure chambers is inflowed;

a main portion which extends in a first direction;

a connecting portion which has an end connected to one end of the main portion, which extends in a second direction, and which has a cross-sectional area, in a direction perpendicular to the second direction, smaller than a cross-sectional area of the main portion in a direction perpendicular to the first direction; and an extended portion which has an end connected to the other end of the connecting portion on a side opposite to the main portion, which extends in a third direction, and which has a cross-sectional area, in a direction perpendicular to the third direction, greater than the cross-sectional area of the connecting portion;

wherein the pressure chambers are arranged in the first direction;

wherein the main portion has a substantially constant cross-sectional area in the direction perpendicular to the first direction; and wherein the inflow port is provided on the main portion at an area on a side opposite to the connecting portion, with the pressure chambers being intervened between the inflow port and the connecting portion.

2. The liquid droplet-jetting apparatus according to claim 1;

wherein the common liquid chamber is defined by a wall surface of the flow passage unit, and a portion, of the wall surface, which defines the connecting portion of the common liquid chamber, protrudes as compared with portions, of the wall surface, which define the main portion and the extended portion, respectively.

3. The liquid droplet-jetting apparatus according to claim 1;

wherein the flow passage unit further includes a bridge which has both ends held by a wall surface, of the flow passage unit, defining the common liquid chamber; and the connecting portion is defined by the bridge and the wall surface.

4. The liquid droplet-jetting apparatus according to claim 1;

wherein the cross-sectional area of the extended portion is 12 to 13 times the cross-sectional area of the connecting portion.

5. The liquid droplet-jetting apparatus according to claim 1;

wherein the cross-sectional area of the extended portion is greater than the cross-sectional area of the main portion.

6. The liquid droplet-jetting apparatus according to claim 1;

wherein the connecting portion includes a plurality of connecting sub-portions; the extended portion includes a plurality of extended sub-portions; and the connecting sub-portion and the extended sub-portions are alternately formed in the first direction.

7. The liquid droplet-jetting apparatus according to claim 1;

wherein the common liquid chamber includes a first liquid chamber and a second liquid chamber;

wherein the main portion, the connecting portion and the extended portion are provided on each of the first and second liquid chambers; and wherein the flow passage unit further includes a linking portion which links an end, of the extended portion belonging to the first liquid chamber, on a side opposite to the connecting portion and an end, of the extended portion belonging to the second liquid chamber, on a side opposite to the connecting portion.

8. The liquid droplet-jetting apparatus according to claim 7;

wherein the linking portion extends in a fourth direction, and a cross-sectional area of the linking portion in a direction perpendicular to the fourth direction is greater than the cross-sectional area of the extended portion.

9. The liquid droplet-jetting apparatus according to claim 1;

wherein the energy-applying mechanism includes a piezoelectric layer which faces the pressure chambers, and a pair of electrodes which apply an electric field to the piezoelectric layer to change a volume of the pressure chambers.

10. The liquid droplet-jetting apparatus according to claim 9;

wherein the piezoelectric layer includes a plurality of individual piezoelectric layers which are stacked in a multilayered form.

11. The liquid droplet-jetting apparatus according to claim 1;

wherein a gap is formed in the flow passage unit at an area which overlaps with the common liquid chamber and which is located on a side opposite to the pressure chambers in a direction perpendicular to the plane.

12. An ink-jet printer which performs recording on a recording medium by jetting liquid droplets of an ink, the ink-jet printer comprising:

an ink-jet head including a flow passage unit which includes a plurality of pressure chambers arranged along a plane, a plurality of nozzles communicated with the pressure chambers respectively, and a common liquid chamber communicated with the pressure chambers;

and an energy-applying mechanism which applies discharge energy to the ink in the pressure chambers; and a transport mechanism which transports the recording medium in a predetermined direction, wherein the common liquid chamber includes:

an inflow port into which the liquid to be supplied to the pressure chambers is inflowed;

a main portion which extends in a first direction;

a connecting portion which has an end connected to one end of the main portion, which extends in a second direction, and which has a cross-sectional area, in a direction perpendicular to the second direction, smaller than a cross-sectional area of the main portion in a direction perpendicular to the first direction; and an extended portion which has an end connected to the other end, of the connecting portion, on a side opposite to the main portion, which extends in a third direction, and which has a cross-sectional area, in a direction perpendicular to the third direction, greater than the cross-sectional area of the connecting portion;

wherein the pressure chambers are arranged in the first direction, the main portion has a substantially constant cross-sectional area in the direction perpendicular to the first direction, and the inflow port is provided on the main portion on a side opposite to the connecting portion, with the pressure chambers being intervened between the inflow port and the connecting portion.

13. The ink-jet printer according to claim 12; further comprising;

a carriage which is movable in a direction intersecting the predetermined direction with the ink-jet head placed thereon.

14. The ink-jet printer according to claim 13;

wherein the cross-sectional area of the extended portion is greater than the cross-sectional area of the main portion.

15. The ink-jet printer according to claim 13;

wherein the connecting portion has a plurality of connecting sub-portions; the extended portion has a plurality of extended sub portions; and the connecting sub-portions and the extended sub-portions are alternately formed in the first direction.

16. The ink-jet printer according to claim 12;

wherein the common liquid chamber is defined by a wall surface of the flow passage unit, and a portion, of the wall surface, which defines the connecting portion of the common liquid chamber, protrudes as compared with portions of the wall surface which define the main portion and the extended portion, respectively.

17. The ink-jet printer according to claim 12;

wherein the flow passage unit further includes a bridge which has both ends held by a wall surface, of the flow passage unit, defining the common liquid chamber, and the connecting portion is defined by the bridge and the wall surface.

18. The ink-jet printer according to claim 12;

wherein the cross-sectional area of the extended portion is 12 to 13 times the cross-sectional area of the connecting portion.

* * * * *